US009855488B2

(12) United States Patent
Dussault

(10) Patent No.: US 9,855,488 B2
(45) Date of Patent: Jan. 2, 2018

(54) SNOWSHOE WITH DOUBLE HINGE BINDING

(71) Applicant: LOUIS GARNEAU SPORTS INC., St-Augustin-de-Desmaures (CA)

(72) Inventor: Geoffroy Dussault, Quebec (CA)

(73) Assignee: LOUIS GARNEAU SPORTS INC., Quebec (CA)

( * ) Notice: Subject to any disclaimer, the term of this patent is extended or adjusted under 35 U.S.C. 154(b) by 385 days.

(21) Appl. No.: 14/160,734

(22) Filed: Jan. 22, 2014

(65) Prior Publication Data

US 2015/0201698 A1 Jul. 23, 2015

(51) Int. Cl.
*A43B 5/04* (2006.01)
*A43B 5/16* (2006.01)
*A63C 13/00* (2006.01)

(52) U.S. Cl.
CPC ..... *A63C 13/003* (2013.01); *A63C 13/006* (2013.01); *A63C 13/005* (2013.01)

(58) Field of Classification Search
CPC ... A63C 13/003; A63C 13/006; A63C 13/005; A63C 13/00
USPC ..... 36/122–125
See application file for complete search history.

(56) References Cited

U.S. PATENT DOCUMENTS 4,348,823 A * 9/1982 Knapp ..... A63C 13/005 36/123
5,253,437 A * 10/1993 Klebahn ..... A63C 13/006 36/122
5,470,621 A * 11/1995 Kashida ..... G03F 1/64 355/122
5,517,772 A * 5/1996 Anderson ..... A63C 13/001 36/122
5,740,621 A * 4/1998 Wing ..... A63C 13/001 36/122
5,918,387 A * 7/1999 Emerson ..... A63C 13/001 280/623
6,112,436 A * 9/2000 Quellais ..... A43C 15/09 36/124
7,194,825 B2 * 3/2007 Faber ..... A43C 15/068 36/124
7,930,842 B2 * 4/2011 Tatsuno ..... A63C 13/006 36/124

(Continued)

OTHER PUBLICATIONS

Canadian Office Action for correponding patent 2,840,616; dated May 7, 2014.

*Primary Examiner* — Jila M Mohandesi
(74) *Attorney, Agent, or Firm* — Cantor Colburn LLP

(57) ABSTRACT

A snowshoe comprises a frame defining a periphery of the snowshoe. A deck is secured in a stretched state to the frame, a cutout being defined in the deck. A binding is connected to at least one of the frame and the deck and being aligned with the cutout in the deck. A footwear support portion is adapted to receive footwear of a wearer and being pivotable relative to the deck along a pivoting range so as to allow a tip of the footwear to plunge through the cutout below a plane of the deck. An unbiased hinge is between the frame and/or the deck and the footwear support portion to allow unbiased movement of the footwear support portion in a proximal portion of the pivoting range. A biased hinge is between the frame and/or the deck and the footwear support portion to allow biased movement of the footwear support portion in a distal portion of the pivoting range.

15 Claims, 4 Drawing Sheets

(56) References Cited

U.S. PATENT DOCUMENTS

| | | | | |
|---|---|---|---|---|
| 7,937,855 | B2 * | 5/2011 | Faber | A63C 13/005 36/122 |
| 2004/0250453 | A1 * | 12/2004 | Settelmayer | A63C 13/001 36/122 |
| 2008/0141564 | A1 | 6/2008 | Matthews et al. | |
| 2011/0113651 | A1 | 5/2011 | Barchet | |

* cited by examiner

SNOWSHOE WITH DOUBLE HINGE BINDING

FIELD OF THE APPLICATION

The present application relates to snowshoes, and to a construction thereof.

BACKGROUND OF THE ART

Snowshoes are commonly used to walk on snow, especially for recreational purposes. Snowshoes come in different configurations, as a function of the physical activity performed with the snowshoes. For instance, snowshoes may come with fixed-rotation bindings, or with full-rotation bindings.

In fixed-rotation bindings, an elastic strap attaches the binding to the snowshoe, so as to bring the tail of the snowshoe up with each step. The snowshoe therefore moves with the foot as a result of the biasing action of the elastic strap, whereby the tail does not drag. Hence, fixed-rotation bindings may be preferred for racing. However, fixed-rotation bindings often cause snow to be kicked up the back of the wearer's legs, by the elastic effect of the biasing.

Similarly to fixed-rotation bindings, full-rotation bindings allow the user's toes to pivot below the deck of the snowshoe, without however opposing a biasing action against the pivoting movement. Hence, full-rotation bindings are often adopted for climbing, yet the absence of substantial biasing results in snowshoes equipped with full-rotation bindings to be awkward for stepping sideways and backwards as the tail of the snowshoe may drag.

Moreover, in order to enhance their performance, snowshoes must be as light as possible. Indeed, snowshoes operate under the principle of flotation on snow, whereby their weight is a design factor.

SUMMARY OF THE APPLICATION

It is therefore an aim of the present disclosure to provide a snowshoe that addresses issues related with the prior art.

Therefore, in accordance with an embodiment of the present application, there is provided a snowshoe comprising: a frame defining a periphery of the snowshoe; a deck secured in a stretched state to the frame, a cutout being defined in the deck; and a binding connected to at least one of the frame and the deck and being aligned with the cutout in the deck, the binding comprising: a footwear support portion adapted to receive footwear of a wearer and being pivotable relative to the deck along a pivoting range so as to allow a tip of the footwear to plunge through the cutout below a plane of the deck; an unbiased hinge between the frame and/or the deck and the footwear support portion to allow unbiased movement of the footwear support portion in a proximal portion of the pivoting range; and a biased hinge between the frame and/or the deck and the footwear support portion to allow biased movement of the footwear support portion in a distal portion of the pivoting range.

In accordance with another embodiment of the present disclosure, there is provided a snowshoe comprising: a frame having at least a tubular member defining a periphery of the snowshoe, the tubular member having a top surface portion of a given width; a deck having a portion of its periphery aligned with and covering at least a portion of the top surface portion of the tubular member over the given width; a plurality of fasteners fixed to the frame by penetrating through the top surface portion of the frame in the given width and through the portion of the deck covering the top surface portion of the frame, the deck being held captive in a stretched state relative to the frame by the fasteners; and a binding operatively connected to at least one of the frame and the deck and adapted to be connected to footwear of a wearer.

DESCRIPTION OF THE PREFERRED EMBODIMENTS

Figure 1:
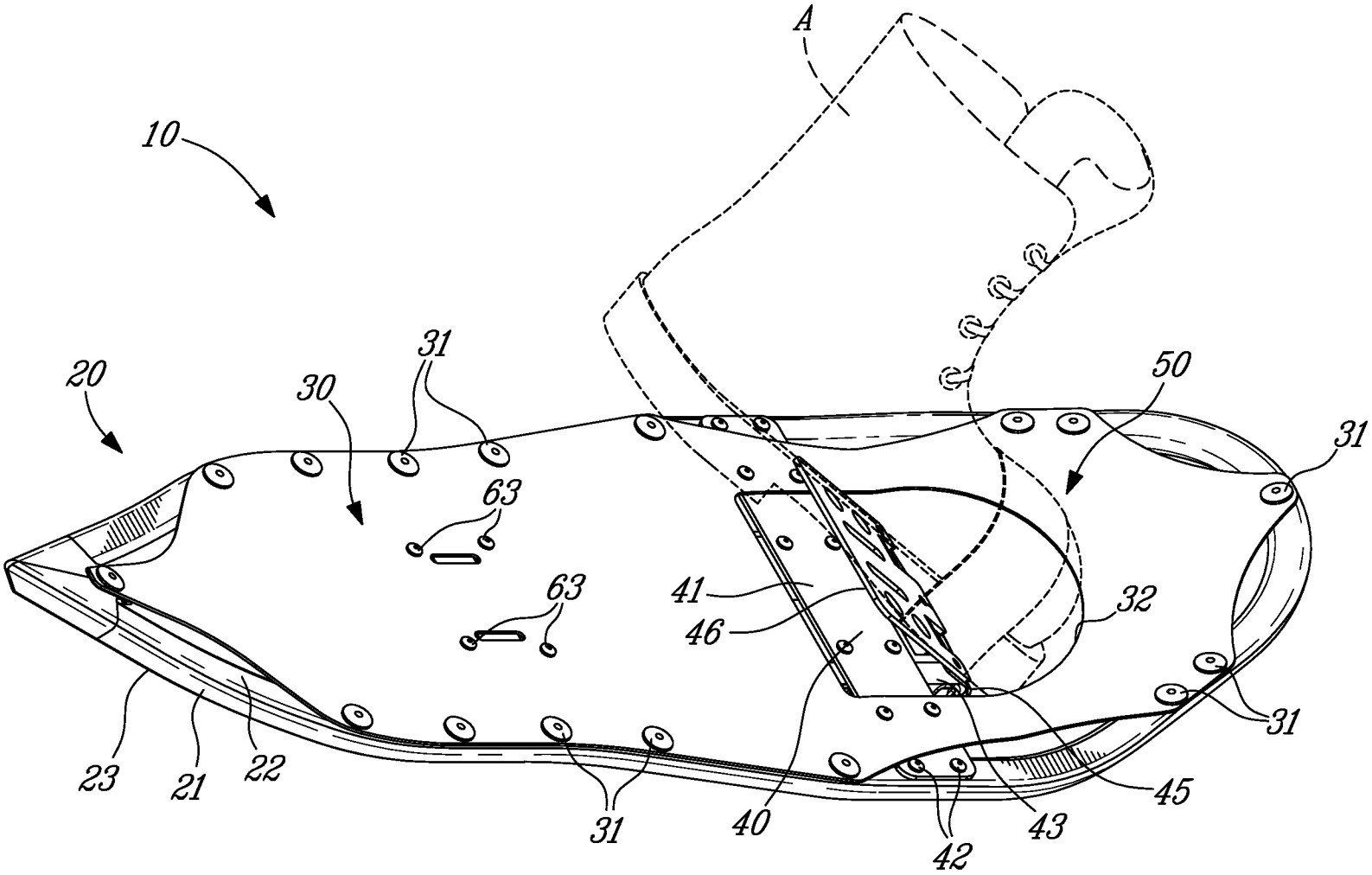
FIG. 1 is a top-side perspective view of a snowshoe of the present disclosure, with a binding thereof allowing non-biased hinging movement.
Figure 2:
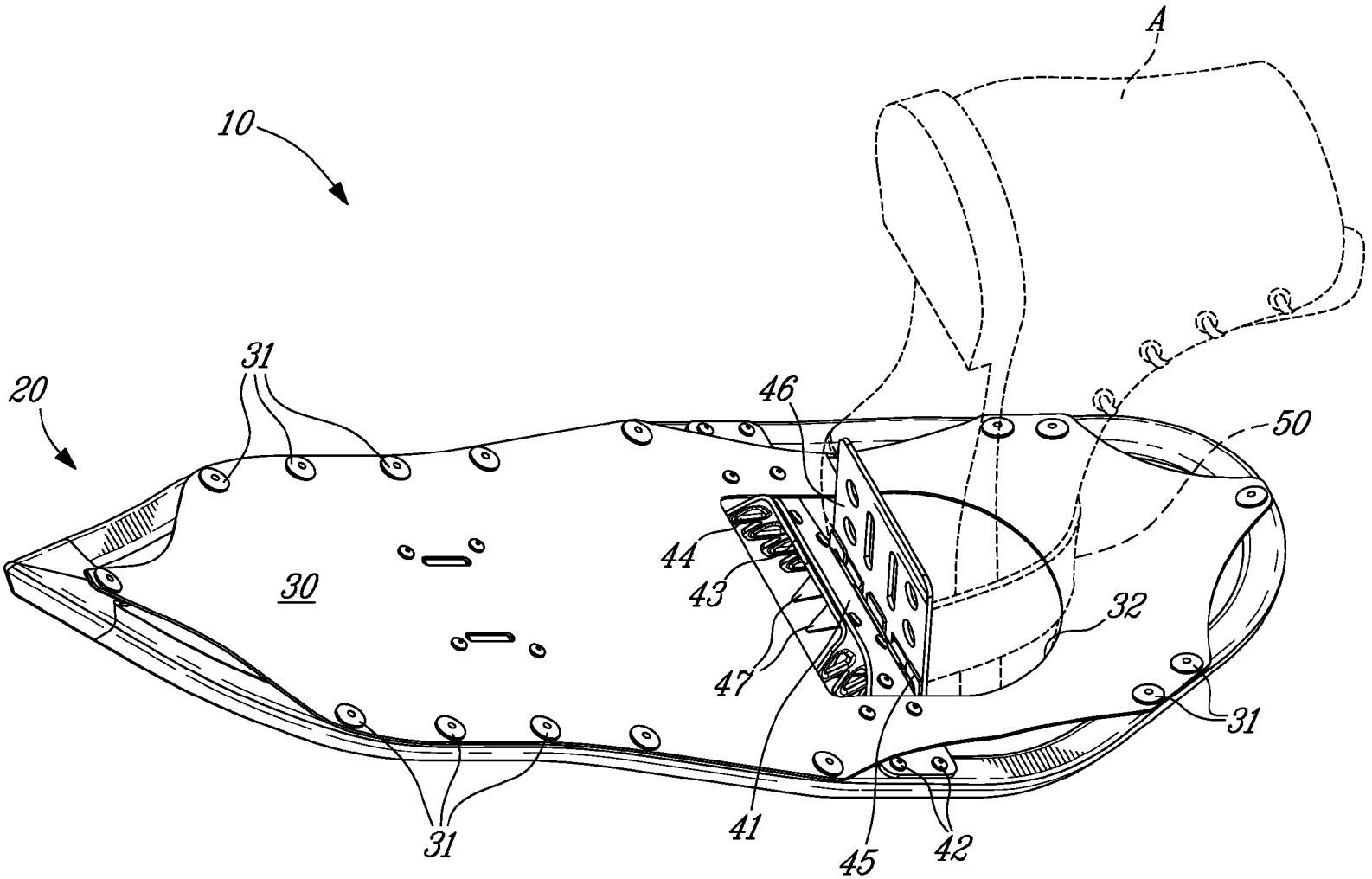
FIG. 2 is a top-side perspective view of the snowshoe of FIG. 1, with the binding thereof allowing biased hinging movement.

Referring to the drawings and more particularly to FIGS. 1 and 2, a snowshoe in accordance with embodiments of the present disclosure is generally shown at 10 (a.k.a., snow shoe, raquette, etc). The snowshoe 10 is conventionally used as part of a pair of snowshoes. The snowshoe 10 of the figures may be a left-side or right-side snowshoe, with or without shape variations between left side or right side. Typically, the snowshoes 10 for left and right side are mirror images of one another, with a harness being oriented as a function of the side of the snowshoe 10. Moreover, the overall shape of the snowshoe 10 may vary as a function of the side. The following description 10 applies to both right-side and left-side snowshoes, unless stated otherwise.

The snowshoe 10 may have a peripheral frame 20, a deck 30, a binding 40 including a harness 50, and a heel cleat unit 60.

The peripheral frame 20 forms the structure of the snowshoe 10, and delimits its footprint. The frame 20 is typically made of a metal/alloys, such as aluminum, titanium, steel, etc, or of composite materials.

The deck 30 defines the majority of the footprint surface of the snowshoe 10, and is hence responsible for spreading the weight of the user, i.e., the deck 30 achieves the flotation effect. The deck 30 may be secured directly to the peripheral frame 20 in a stretched state, in accordance with an embodiment of the present disclosure described hereinafter. The deck 30 is made of any suitable panel material, such as textiles, polymers, tarps, woven, non-woven, to name but a few, with properties such as puncture resistance, tear resistance, etc.

The binding 40 is the interface between the boot A or shoe of the wearer (hereinafter boot for simplicity), and the snowshoe 10. Moreover, in accordance with an embodiment of the present disclosure described below, the binding 40 may allow a double hinging movement of the boot.

The harness 50 is part of the binding 40 (although likely removable from a remainder of the binding 40) that is designed to releasably secure the boot to the binding 40 and hence to the snowshoe 10. The harness 50 is only schematically shown in the figures, as a vast number of different harness configurations are considered, within the scope of the present disclosure.

The heel cleat unit 60 may be provided on an underside of the deck 30, to provide additional traction to the snowshoe 10.

Referring to FIGS. 1 and 2, the peripheral frame 20 is shown having a tear-drop like shape, which shape is disclosed as a non-limitative example, as various other shapes are considered. Likewise, the nose and/or tail of the frame may raise slightly upwards as in FIGS. 1 and 2, or may adopt other configurations, such a generally flat geometry, etc.

Figure 4:
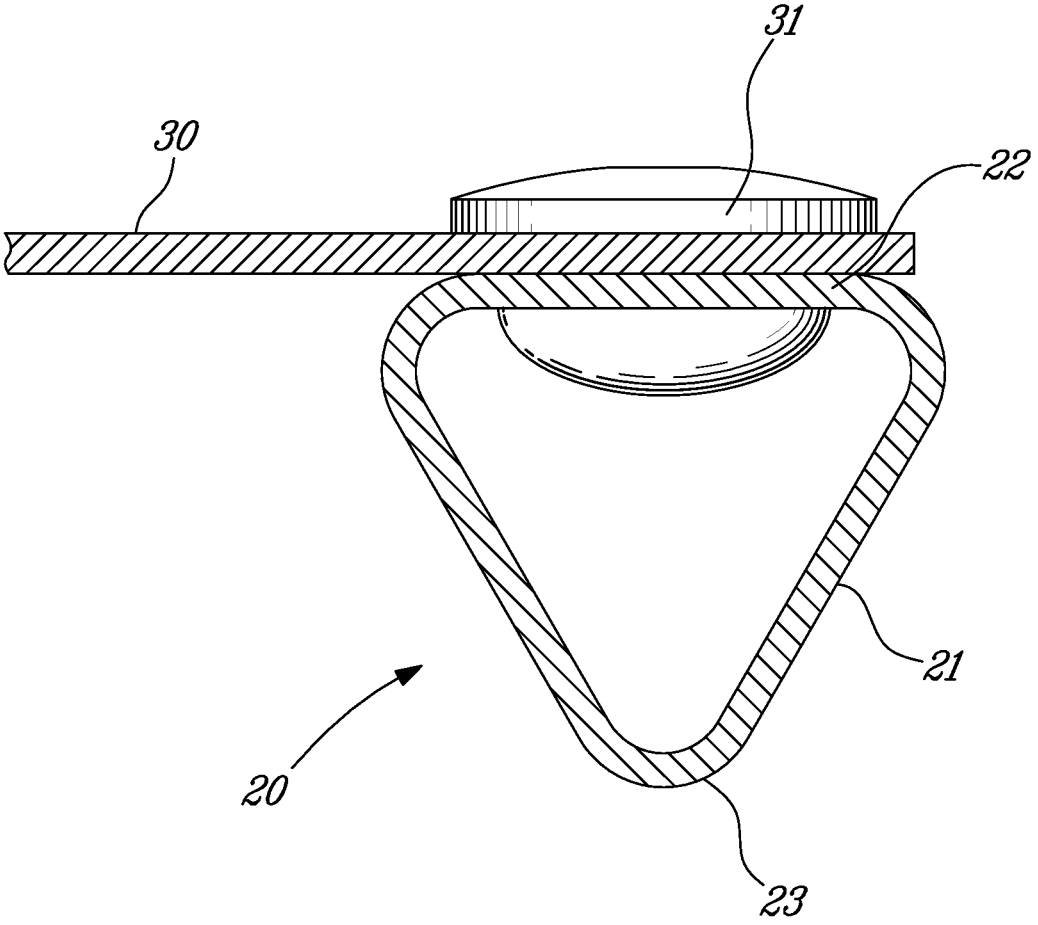
FIG. 4 is a sectional view of an interconnection between a peripheral frame and a deck in a snowshoe, such as the snowshoe of FIG. 1.

Referring to FIG. 4, a section of the peripheral frame 20 is shown. The frame 20 may have a triangular section 21 as in FIG. 4, with a downwardly-facing apex. Although the expression "triangular" is used, the expression should be interpreted as having three sides, not necessarily perfectly straight, and without sharp edges, for instance to avoid hazards (e.g., edges may be rounded). It is also observed that the peripheral frame 20 is a tubular frame, in that it is made of a hollow tube (i.e., frame defined by a tube extending lengthwise along the periphery of the snowshoe 10), and could be open as opposed to closed. It is also considered to have a solid frame 20 as opposed to a tubular frame, provided the weight of the solid frame 20 is not excessive by an appropriate section of materials.

By way of the arrangement of FIG. 4, the frame 20 has a generally flat top support surface 22 of a given width, for a tapered bottom 23 (i.e., the downwardly-facing apex). Hence, the deck 30 may be secured directly to the frame 20, as the support surface 22 of the frame 20 defines sufficient space in the given width for fasteners 31 to fasten the deck directly against the frame 20, i.e., without additional interfacing brackets, or without loops of excessive deck material surrounding the frame 20. In the illustrated embodiment, the fasteners 31 are rivets being passing through the deck 30 and the support surface 22 of the frame 20, to keep the deck 30 stretched and taut in the manner shown in FIG. 1. In such cases, the frame 20 and the deck 30 may be pre-machined or pre-manufactured with holes to receive the rivets 31. Other fasteners may be used, such as screws or bolts, with appropriate tapping in the frame 20. In the embodiment shown, the head of the rivets 31 is sufficient to hold the deck 30 captive against the frame 20. Other components, such as washer, etc, could be sandwiched between the head of the fasteners 31 and the deck 30. Moreover, by the downwardly-facing apex, the tapered bottom 23 may provide additional purchase to the frame 20 compared with flatter bottom shapes of prior art frames. Stated differently, the frame 20 has a traction component at its bottom, to provide additional traction over flat or circular frames. The tapered bottom 23 is one among other possible configurations, other arrangements including a serrated bottom surface, an abrasive coating on the bottom surface, etc.

While the triangular-like section 21 is well suited to provide addition purchase and to form appropriate support for the deck 30 in the direct connection with fasteners 31, other sectional shapes are considered. For instance, square, trapezoid, oval and/or rounded shapes could achieve suitable results as well.

Referring to FIGS. 1 and 2, the deck 30 is shown having a geometry substantially similar to that of the peripheral frame 20, as a result of the direct interconnection of the deck 30 to the frame 20, as described above. The deck 30 has a cutout 32, which cutout 32 allows the front of the boot to plunge below the plane of the deck 30, in a typical walking/running motion. The binding 40 is secured to the snowshoe 10 in register with the cutout 32. The binding 40 has an elastic band 41 (a.k.a., strip). The elastic band 41 has opposed ends secured to the frame 20 with fasteners 42, for instance in a similar manner to the direct interconnection between frame 20 and deck 30 as shown in FIG. 4, although other arrangements are possible, such as loops, brackets, etc. Moreover, the elastic band 41 could also be secured to the deck 30.

A base plate 43 is fixed to the elastic band 41, so as to move therewith for instance as a result of a twist of the elastic band 41. The base plate 43 is made of a rigid material, such as a metal. As the elastic band 41 has a section thereof coplanar and fixed to the base plate 43 (by rivets or like fasteners visible in the figures), this section of the elastic band 41 generally remains coplanar against the base plate 43 at all times. As observed in FIG. 3, lateral cleats 44 (i.e., crampons, teeth) project downwardly from the base plate 43, and the lateral cleats 44 provide purchase to the forefoot region of the boot sole when the snowshoe 10 is worn. In an embodiment, as illustrated in FIGS. 1-3, the base plate 43 and lateral cleats 44 are a monolithic piece of bent and machined metal stock, although other configurations are considered, such as molded metal, composites, etc.

The elastic band 41 forms the biased hinge of the binding 40 (i.e., a fixed-rotation hinge). The elastic band is made of a material having elastic properties, such as natural or synthetic rubber, polymers, the selected material being capable of sustaining cold temperatures associated with snow and winter. As shown in FIGS. 1-3, sections of the elastic band 41 extend from opposite sides of the base plate to the frame 20. These sections may twist by plastic deformation, in the manner shown in FIG. 2, allowing a hinging movement of the base plate 43 relative to the deck 30. The rest state of the elastic band 41 is as in FIG. 1 with the elastic band 41 being flat, whereby the twisting shown in FIG. 2 will result in biasing forces produced by the elastic band 41 to return to the rest state of FIG. 1.

In accordance with an embodiment, the snowshoe 10 may also comprise an unbiased hinge 45 (i.e., a full-rotation hinge), defining unbiased hinging to the snowshoe 10. The hinge 45 is between a front edge of the base plate 43, and a front portion of a foot plate 46. The foot plate 46 is the part of the binding 40 that remains against the forefoot region of the boot sole when the snowshoe 10 is worn. As observed in FIG. 3, front cleats 47 (i.e., crampons, teeth) project downwardly and forwardly from the foot plate 46, and the front cleats 47 provide purchase to the forefoot region of the boot sole when the snowshoe 10 is worn and the forefoot region plunges through the cutout 32 below the plane of the deck 30. In an embodiment, as illustrated in FIGS. 1-3, the foot plate 46 and cleats 47 are a monolithic piece of bent and machined metal stock, although other configurations are considered, such as molded metal, composites, etc, with various orientations of the cleats 47.

Figure 3:
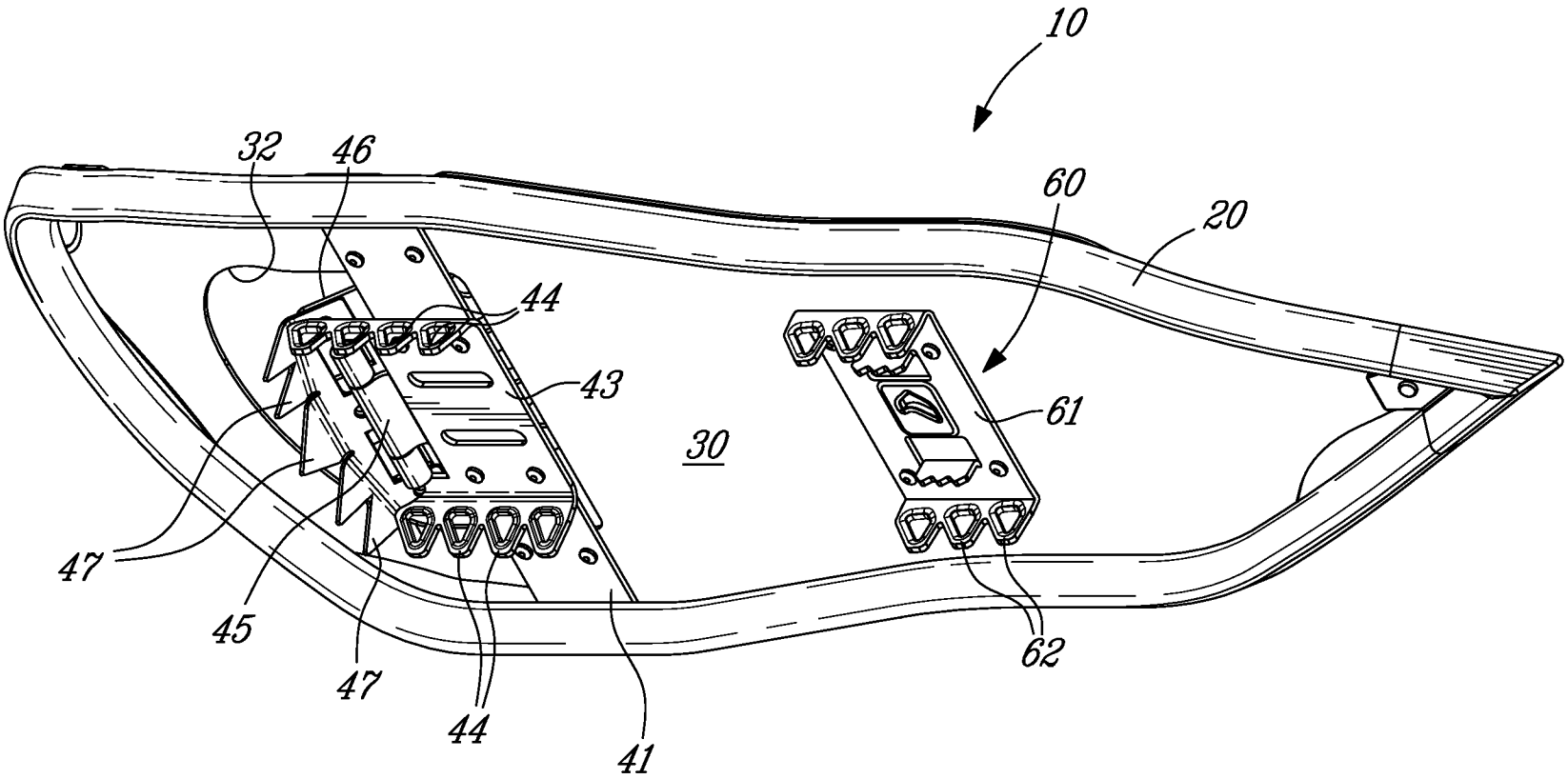
FIG. 3 is an underside perspective view of the snowshoe of FIG. 1.

The hinge 45 may have a conventional door-hinge like configuration, with a rod threaded through a channel formed jointly by the base plate 43 and the foot plate 46, in the manner shown in FIGS. 1-3. The base plate 43 and the foot plate 46 are configured such that the pivoting range of motion of the hinge 45 is limited between a coplanar orientation, in which the foot plate 46 lies against the base plate 43 (or raised therefrom slightly), and a raised orientation, as in FIG. 1. In the raised orientation, the angle is between 20 and 35 degrees, for example. Beyond the raised orientation, any additional rotation movement of the foot relative to the deck 30, e.g., to reach the orientation of FIG. 2, will require the plastic deformation of the elastic band 41.

Referring to FIGS. 1 and 2, the harness 50 is schematically shown, and is used to tie down the boot A to the foot plate 46, in such a way that the boot A and the foot plate 46 rotate concurrently, as they are concurrently part of the footwear support portion of the binding 40. Thus, in the illustrated embodiment, the harness 50 is tied to the foot plate 46. As mentioned above, any appropriate configuration of harness 50 is considered.

Referring to FIG. 3, the heel cleat unit 60 may be secured to the deck 30, in alignment with a heel portion of the boot A when the boot A is against the deck 30. The heel cleat unit 60 may have a heel plate 61 and cleats 62 (a.k.a., teeth, crampons). As observed in FIG. 3, the cleats 62 project downwardly from the heel plate 61, the cleats 62 providing purchase to the heel region of the boot sole when the snowshoe 10 is worn. In an embodiment, as illustrated in FIG. 3, the heel plate 61 and cleats 62 are a monolithic piece of bent and machined metal stock, although other configurations are considered, such as molded metal, composites, etc.

Now that the various components of the snowshoe 10 have been described, a motion of the binding 40 is set forth.

From a start point in which the sole of the boot A is generally planar against the deck 30, or at its lowermost orientation relative to the deck 30 (e.g., when a heel bar is used), the boot A is rotated such that the forefoot region of the boot A plunges into the cutout 32 of the deck 30, in a typical walking or running movement. As the boot A is strapped to the snowshoe 10 by way of the harness 50, the binding 40 will allowing hinging movements of its components. Firstly, in a proximal portion of the whole pivoting range of movement of the binding 40, the foot plate 46 will pivot about the base plate 43, by the action of the hinge 45. Indeed, the hinge 45 does not oppose substantial forces against the hinging movement of the foot plate 46, in comparison to the elastic band 41 opposing biasing forces against movements from the start point mentioned above. This movement is qualified as being unbiased, in the sense that no substantial biasing force is opposed to movement of the foot plate 46 relative to the base plate 43 (gravity is not to be considered a biasing force).

If the boot A is rotated back down before reaching the raised orientation, the deck 30 will remain generally parallel to the ground and will not have its tail kick up. Accordingly, the hinge 45 acts in similar fashion to a full-rotation binding up to the raised orientation of the boot A defined above, for the proximal portion of the pivoting range of the binding 40.

On the other hand, if the boot A continues rotating to a distal portion of the pivoting range of movement of the binding 40, as shown in FIG. 2, the hinge 45 will reach its distal limit, whereby subsequent rotation of the foot plate 46 relative to the deck 30 will be permitted by the plastic deformation of the elastic band 41, whereby the binding 40 will perform some biased movement, in that the footwear support portion of the binding 40 will be biased toward the rest state of the elastic band 41. The elastic band 41 acts in similar fashion to a fixed-rotation binding, but only beyond the raised orientation of the hinge 45, in the distal portion of the pivoting range of movements. The kicking effect is thus reduced compared to snowshoes 10 having a conventional fixed-rotation binding.

The invention claimed is:

1. A snowshoe comprising:

a frame defining a periphery of the snowshoe;

a deck secured in a stretched state to the frame, a cutout being defined in the deck; and a binding connected to at least one of the frame and the deck and being aligned with the cutout in the deck, the binding comprising:

a footwear support portion adapted to receive footwear of a wearer and being pivotable relative to the deck along a pivoting range so as to allow a tip of the footwear to plunge through the cutout below a plane of the deck;

an unbiased hinge between the frame and/or the deck and the footwear support portion to allow unbiased rotational movement of the footwear support portion about a first axis of rotation in a proximal portion of the pivoting range; and a biased hinge between the frame and/or the deck and the footwear support portion to allow biased rotational movement of the footwear support portion about a second axis of rotation in a distal portion of the pivoting range, wherein the first axis of rotation is generally parallel to the second axis of rotation, the unbiased hinge and the biased hinges allowing the tip of the footwear to plunge through the cutout below the plane of the deck by rotation about the first and the second axes of rotation.

2. The snowshoe according to claim 1, wherein the biased hinge comprises an elastic band connected to the footwear support portion, the elastic band being plastically deformable by twisting to allow the distal portion of the pivoting range.

3. The snowshoe according to claim 2, wherein the elastic band is directly connected to the frame at opposed ends by fasteners penetrating the frame.

4. The snowshoe according to claim 1, wherein the biased hinge comprises a base plate connected to the unbiased hinge.

5. The snowshoe according to claim 4, wherein the base plate has cleats projecting downwardly therefrom and through the cutout.

6. The snowshoe according to claim 2, wherein the biased hinge comprises a base plate connected to the unbiased hinge, the base plate being secured to the elastic band in a coplanar fashion.

7. The snowshoe according to claim 1, wherein the footwear support portion comprises a footplate connected to the unbiased hinge, the footplate adapted to receive thereagainst a forefoot portion of the footwear.

8. The snowshoe according to claim 7, further comprising cleats projecting downwardly and forwardly from the footplate.

9. The snowshoe according to claim 1, wherein a maximum angle of the footwear support portion in the proximal portion of the pivoting range is between 20 to 35 degrees relative to a plane of the deck, the distal portion of the pivoting range between greater than the maximum angle.

10. A snowshoe comprising:

a frame having at least a tubular member defining a periphery of the snowshoe, the tubular member having a flat top surface portion of a given width;

a deck separate from the deck and having a portion of its periphery aligned with and covering at least a portion of the top surface portion of the tubular member over the given width;

a plurality of fasteners fixed to the frame by penetrating through the top surface portion of the frame in the given width and through the portion of the deck covering the top surface portion of the frame, the deck being held captive in a stretched state relative to the frame by the fasteners; and a binding operatively connected to at least one of the frame and the deck and adapted to be connected to a footwear of a wearer.

11. The snowshoe according to claim 10, wherein the deck is sandwiched between the top surface of the frame and a head of the fasteners.

12. The snowshoe according to claim 10, wherein the fasteners are rivets, with a portion of the rivets being held captive in an inner cavity of the tubular member.

13. The snowshoe according to claim 10, wherein a bottom surface of the tubular member has a traction component.

14. The snowshoe according to claim 10, wherein the tubular member has a section defining a tapering bottom portion from the flat top surface portion.

15. The snowshoe according to claim 10, wherein the tubular member has a downwardly facing triangular-like section.

* * * * *